US005167436A

United States Patent [19]

Wu

[11] Patent Number: 5,167,436

[45] Date of Patent: Dec. 1, 1992

[54] STRUCTURE OF BUILT-UP CHAIR

[76] Inventor: Meng-Fang Wu, No. 445, Chung Cheng Road, Panchiao City, Taipei Hsien, Taiwan

[21] Appl. No.: 706,845

[22] Filed: May 29, 1991

[51] Int. Cl.[5] ..... A47C 3/20; A47C 4/02

[52] U.S. Cl. ..... 297/338; 297/440; 297/446

[58] Field of Search ..... 297/338, 345, 346, 440, 297/444, 445–447; 108/96, 106, 107, 110, 144

[56] References Cited

U.S. PATENT DOCUMENTS 4,109,961 8/1978 Opsuik ..... 297/338
4,793,654 12/1988 Takafuji ..... 297/338
4,958,885 9/1990 Kassai ..... 297/345 X

FOREIGN PATENT DOCUMENTS 864739 1/1953 Fed. Rep. of Germany ..... 297/446

*Primary Examiner*—Peter R. Brown
*Attorney, Agent, or Firm*—Bacon & Thomas

[57] ABSTRACT

A built-up chair, comprising two stands connected together by a connecting bar, two pairs of supports respectively mounted on said two stands at the top, two side bars respectively mounted on said two pairs of supports and connected together by two cross bars for holding a seat, and a back support connected between said two pairs of supports at the top. By fastening connecting bolts in connectors, the two stands and the two side bars are respectively connected to the connecting bar or the cross bars at two opposite ends. The seat is fastened in the two side bars through sliding joint and supported by the two cross bars. The back support has two rows of holes for fastening in between the two pairs of supports by screws at the top. The two pairs of supports have each a plurality of parallel grooves at the middle for adjusting the level position of the side bars easily.

4 Claims, 6 Drawing Sheets

STRUCTURE OF BUILT-UP CHAIR

BACKGROUND OF THE INVENTION

The present invention relates to built-up chairs and relates more particularly to a built-up chair which is easy to assembly and strong in structure.

According to conventional manufacturing process, a chair is generally comprised of a plurality of parts which are connected together by tongue-and-groove or mortise-and-tenon joint and then firmly secured in shape by fastening screws. This processing process is generally completed at factory and not detachable. Disadvantages of the conventional structure of chairs are numerous and outlined hereinafter.

1. Because it is factory made, it occupies much space in delivery and storage;
2. It is not strong in structure after assembly and the connecting parts may be disconnected from place easily to affect its service life;
3. It is not detachable;
4. Because the connecting parts may disconnect from place easily, product design is limited; and
5. The back support or the seat can not be adjusted to best fit individual body size or, if the seat is adjustable the cost will be very expensive.

SUMMARY OF THE INVENTION

According to the present invention, there is provided a built-up chair which comprises two stands connected together by a connecting bar, two pairs of supports respectively mounted on said two stands at the top, two side bars respectively mounted on said two pairs of supports and connected together by two cross bars for holding a seat through sliding joint, and a back support connected between said two pairs of supports at the top. The two pairs of supports have each a plurality of parallel grooves convenient for alignment of the two side bars during level position adjusting process. The back support has two rows of holes alternatively aligned with the bolt holes and the through-holes on either pair of the supports for fastening by screws and for convenient position change.

DETAILED DESCRIPTION OF THE PREFERRED EMBODIMENT

Figure 1:
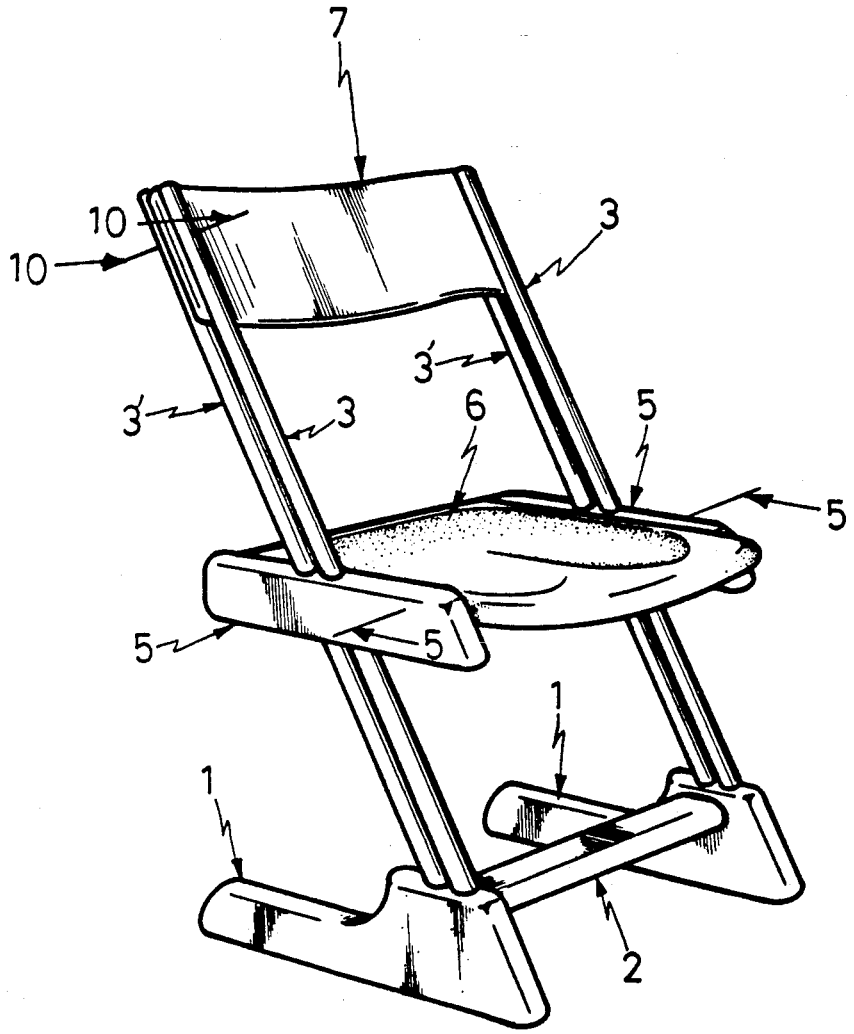
FIG. 1 is a perspective view of the preferred embodiment of the built-up chair of the present invention.

Referring to FIG. 1, a built-up chair in accordance with the present invention is generally comprised of two stands 1 connected together by a connecting bar 2, two pairs of supports 3 and 3' respectively mounted on said two stands 1 at the top, two side bars 5 respectively mounted on said two pairs of supports 3 and 3' and connected together by two cross bars 4 for holding a seat 6, and a back support 7 connected between said two pairs of supports 3 and 3' at the top.

Figure 2:
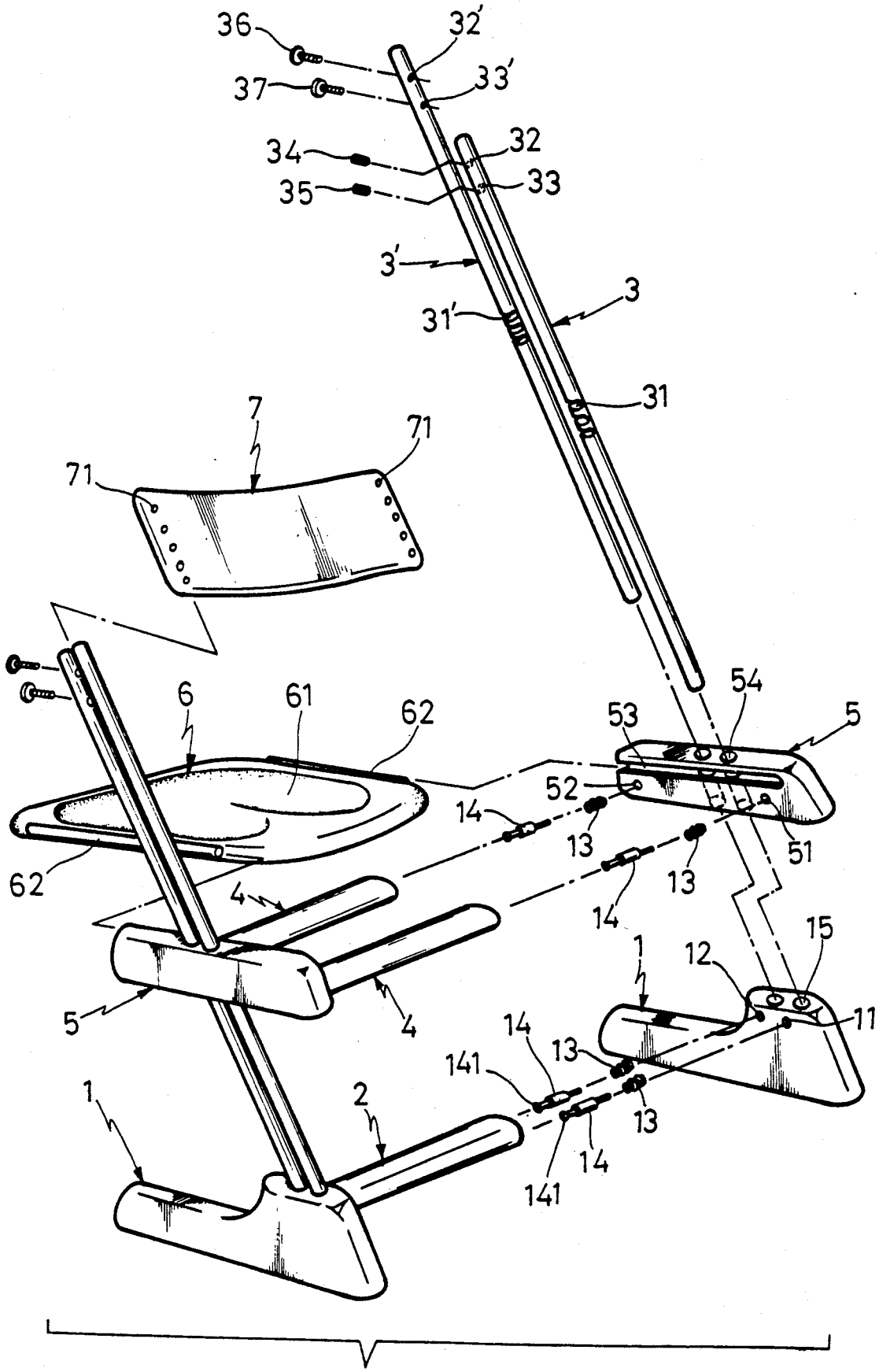
FIG. 2 is an exploded perspective view of thereof.
Figure 3:
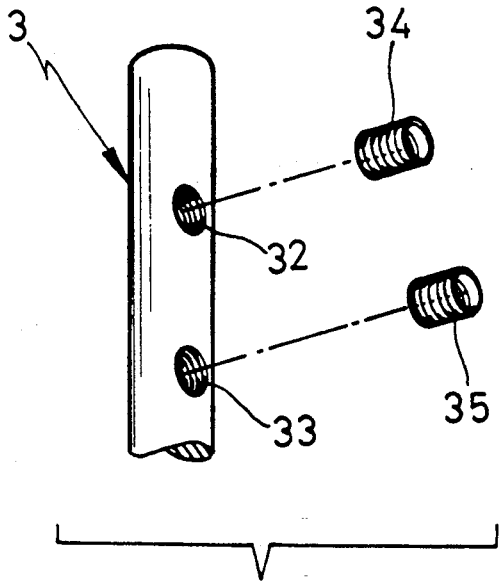
FIG. 3 is a partly perspective and enlarged view of the front piece which is disposed at the front in each pair of supports.
Figure 4:
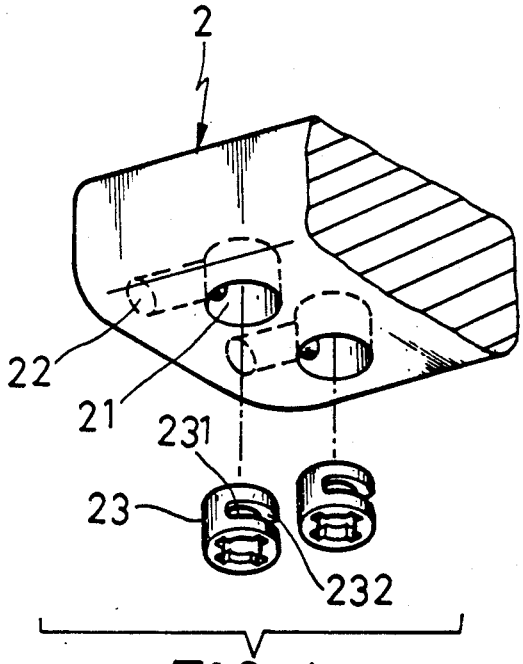
FIG. 4 is a partly perspective and enlarged view of the connecting bar and the connectors therein.
Figure 5:
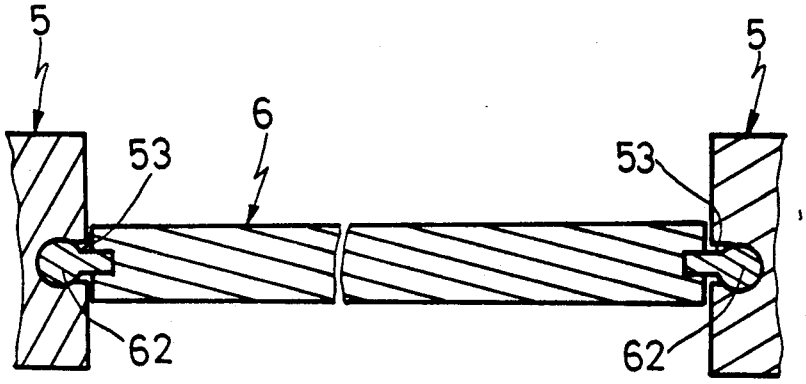
FIG. 5 is a sectional view taken along line 5—5 on FIG. 1, illustrating the connection of the guide rods of the seat in the channels of the side bars.
Figure 6:
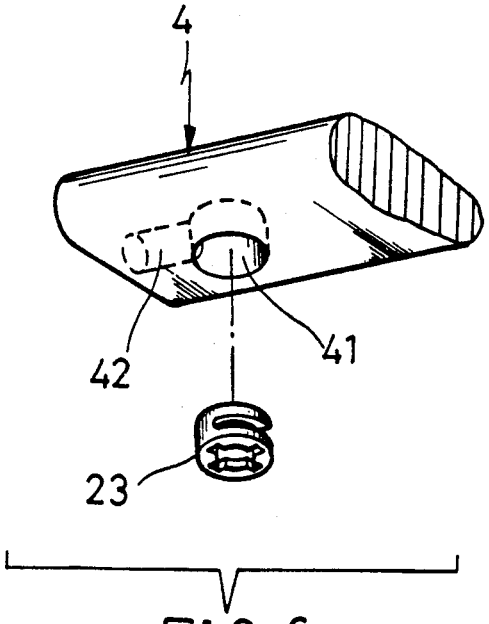
FIG. 6 is a partly perspective and enlarged view of the cross bar and the connector therein.

As shown in FIG. 2, each stand 1 has two small holes 11 and 12 on one side with a bush 13 each respectively fastened therein for holding a connecting bolt 14 each, which connecting bolt 14 has a flange 141 at one end exposed to the outside, and two fastening holes 15 obliquely made on the top. As indicated, the connecting bar 2 has two opposite ends respectively connected to the two stands 1. On each connecting end of the connecting bar 2, as shown in FIG. 4, there are two blind holes 21 vertically made at the bottom with a connector 23 each respectively fastened therein, and two through-holes 22 transversely made at the outer edge thereof in communicating with said blind holes 21 respectively. The connector 23 which has a groove 232 on the periphery thereof in communication with the wedge-shaped hole 231 defined therein is provided to match with the connecting bolt 14 for connecting the connecting bar 2 to the stands 1. The two pairs of supports 3 and 3' are respectively fastened in two fastening holes 15 on the stands 1, having each a plurality of parallel grooves 31 or 31' transversely made at the middle. In each pair of supports 3 and 3', as shown in FIG. 3, the front piece 3 which is disposed at the front has two spaced bolt holes 32 and 33 at near the top end thereof and, the back piece 3' which is disposed at the back has two through-holes 32' and 33'. Referring to FIG. 6, similar to the connecting bar 2, the two opposite ends of each cross bar 4 has a blind hole 41 vertically made at the bottom with a connector 23 fastened therein, and a through-hole 42 transversely made on the outer edge thereof in communicating with the blind hole 41. Referring to FIG. 2 again, each side bar 5 has two opposite small holes 51 and 52 at one side with a bush 13 each respectively fastened therein for holding a connecting bolt 14 each, an elongated channel 53 disposed above said small holes 51 and 52 which has one closed and one end opened for fastening the seat 6 through sliding joint, two through-holes 54 a the top for inserting either pair of supports 3 and 3'. The seat 6 has a curved bearing surface 61 orthopedically engineered at the top to comfort sitting, two guide rods 62 at two opposite sides. Referring to FIG. 5, by inserting the two guide rods 62 into the channel 53 of the two side bars 5, the seat 6 is fastened in the two side bars 5 and supported by the two cross bars 4. Referring to FIGS. 1 and 2 again, the back support 2 is orthopedically engineered to fit human's back, having two rows of holes 71 at two opposite ends for fastening in between the two pairs of supports 3 and 3' at the top by screws 36 and 37.

Figure 7:
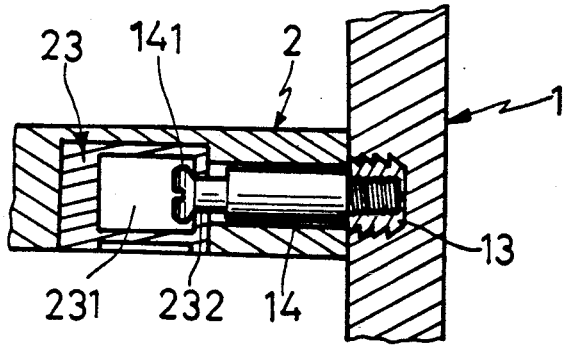
FIG. 7 is a partly sectional view of the stand with the connecting bar.
Figure 8:
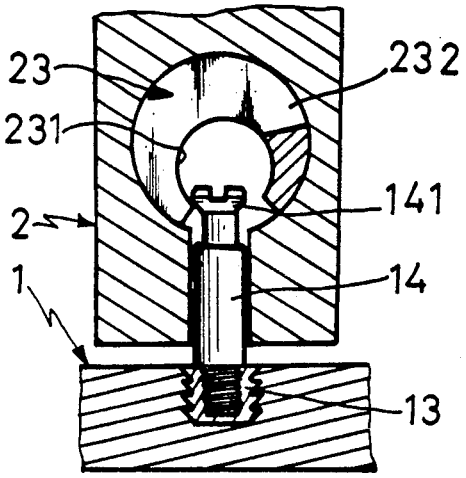
FIGS. 8 and 9 sectional views showing the procedure in fastening the connecting bolt in the connector.
Figure 9:
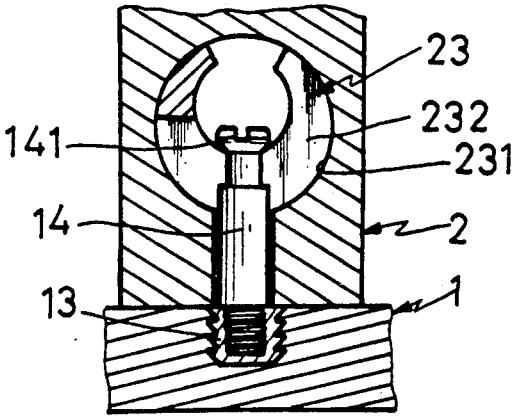
Figure 10:
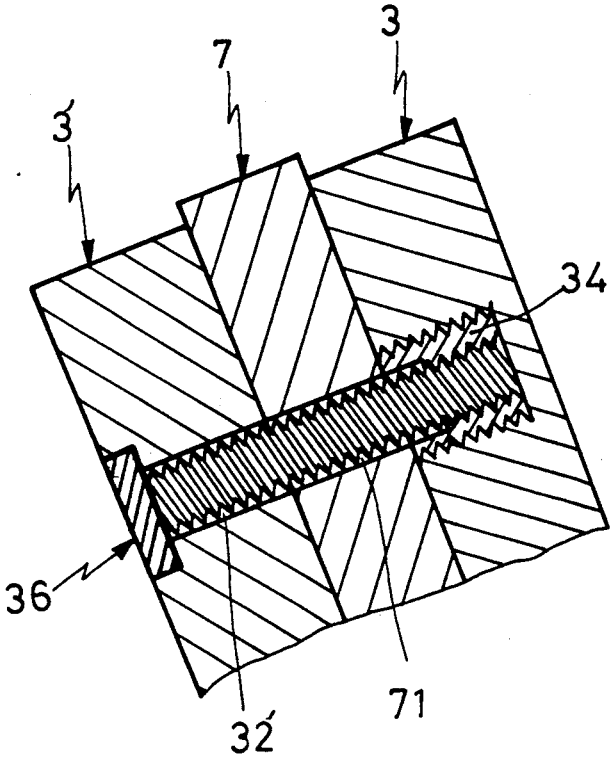
FIG. 10 is a sectional view taken along line 10—10 on FIG. 1, illustrating the connection of the back support with the two pairs of supports.

To assemble the aforesaid parts into a chair is easy and outlined hereinafter. Insert the flange 141 of every connecting bolt 14 of the stands 1 through the through-hole 22 and the blind hole 21 on either end of the connecting bar 2 into the connector 23 therein, as shown in FIGS. 7, 8 and 9, and then rotate the connector 23 through a suitable angle relative to the connecting bolt 14 permitting the flange 141 of the connecting bolt 14 to be firmly retained in the wedge- shaped hole 232. Thus, the stands 1 are bilaterally connected to the connecting bar 2 at two opposite ends. Through the same process, the two side bars 5 are bilaterally connected to the two cross bars 4 at two opposite ends. Then, the two pairs of supports 3 and 3' are respectively fastened in the fastening holes 15 of the two stands 1. After the two pairs of supports 3 and 3' are respectively fastened in the two stands 1, the two side bars 5 with the connected two cross bars 4 are mounted on the two pairs of supports 3 and 3' by inserting the two pairs of supports 3 and 3' through the through-holes 54 of the two side bars 5 respectively, permitting the two side bars 5 to be allocated at the parallel grooves 31 or 31' with the channels 53 thereof disposed in alignment with either one of the parallel grooves 31 or 31'. By alternatively aligning the channels 53 with the parallel grooves 31 and 31', the two side bars 5 can be conveniently adjusted to a desired level position. As soon as the two side bars 5 with the two cross bars 4 are mounted on the two pairs of supports 3 and 3', the seat 6 is fastened in the two side bars 5 and supported by the two cross bars 4 by inserting the two guide rods 62 of the seat 6 into the channels 53 of the side bars 5. After the seat 6 having been fastened in place, the back support 7 is inserted in between the two pairs of supports 3 and 3' permitting the bolt holes 32 and 33 and the through-holes 32' and 33' of the two pairs of supports 3 and 3' to be respectively aligned with either pair of the two rows of holes 71 for fastening two screws 36 and 37 to firmly secure the back support 7 in position. By alternatively aligning the two rows of holes 71 with the bolt holes 32 and 33 and the through-holes 32' and 33', the position of the back support 7 on the two pairs of supports 3 and 3' can be conveniently adjusted.

According to foregoing statement, the present invention is to provide such a built-up chair which provides various advantages including the followings:

1. It is easy to assemble by using only one screw driver;

2. It is strong in structure and durable in use;

3. By inserting the connecting bolts in the connectors respectively and then rotating the connectors relative to the connecting bolts, the stands and the side bars are conveniently firmly secured to the connecting bar or cross bars;

4. By alternatively aligning the channels of the side bars with the parallel grooves on the two pairs of supports, the seat can be conveniently adjusted to a suitable height;

5. By alternatively aligning the two rows of holes of the back support with the bolt holes and through-holes of the two pairs of supports, the back support can be conveniently adjusted to a suitable position to comfortably support the back of the person who sits on the seat;

6. It can be conveniently disassembled to reduce space occupation for convenient delivery or storage; and 7. It is easy and inexpensive to manufacture.

What is claimed is:

1. A built-up chair, comprising two stands connected together by a connecting bar, two pairs of supports respectively mounted on said two stands at the top, two side bars respectively mounted on said two pairs of supports and connected together by two cross bars for holding a seat, and a back support connected between said two pairs of supports at the top, wherein:

said stands have two small holes at one side with a bush each respectively fastened therein for holding a connecting bolt each, and two fastening holes obliquely made on the top for fastening said two pairs of supports;

said connecting bar has two connecting portions at two opposite ends for connecting said stands, said connecting portions having each two blind holes vertically made at the bottom with a connector each respectively fastened therein and two through-holes transversely made at the outer edge thereof in communicating with the blind holes thereof respectively;

said two pairs of supports are each comprised of a front piece disposed at the front and a back piece disposed at the back, said front piece having a plurality of parallel grooves transversely made at the middle and two bolt holes near the top end thereof, said back piece having a plurality of parallel grooves transversely made at the middle and two through-holes near the top end thereof corresponding to the two bolt holes on said front piece;

said two side bars have each two opposite small holes at one side with a bush each respectively fastened therein for holding a connecting bolt each for fastening said cross bars, an elongated channel disposed above the small holes thereof for fastening said seat, and two through-holes at the top for inserting said two pairs of supports;

said two cross bars have each two connecting portions at two opposite ends for fastening said two side bars, which two connecting portions have each a blind hole vertically made at the bottom with a connector fastened therein and a through-hole transversely made on the outer edge thereof in communicating with the blind hole thereof;

said seat has a curved bearing surface at the top for sitting and two guide rods at two opposite sides respectively fastened in said elongated channel on said two side bars and one of said parallel grooves on each of said front and back pieces of said two pairs of supports through a sliding joint; and said back support has two rows of holes at two opposite ends respectively alternatively aligned with the bolt holes of the front piece of either pair of said two pairs of supports and the through-holes of the back piece of either pair of said two pairs of supports for fastening by screws.

2. The built-up chair of claim 1, wherein said connector has a groove on the periphery thereof in communicating with a wedge-shaped hole defined therein and said connecting bolt has a flange at one end; said connecting bolt is firmly fastened in said connector by rotating said connector through a suitable angle relative to said connecting bolt after said flange of said connecting bolt having been inserted through the groove of said connector into said wedge-shaped hole.

3. The built-up chair of claim 1, wherein the position of said two side bars on said two pairs of supports is adjusted by aligning said channel with either of said parallel grooves.

4. The built-up chair of claim 1, wherein said two rows of holes of said back support are alternatively aligned with the bolt holes and the through-holes of said two pairs of supports for fastening in between said two pairs of supports by screws at the top and for adjusting its position relative to said two pairs of supports.

* * * * *